United States Patent [19]

Kitahara et al.

[11] Patent Number: 4,774,508

[45] Date of Patent: Sep. 27, 1988

[54] METHOD OF FORMING MATRIX IMAGE

[75] Inventors: Kiyoshi Kitahara, Tokyo; Takahiko Fukuzawa, Hoya, both of Japan

[73] Assignee: Citizen Watch Co., Ltd., Tokyo, Japan

[21] Appl. No.: 896,331

[22] Filed: Aug. 14, 1986

[30] Foreign Application Priority Data

Aug. 15, 1985 [JP] Japan ..... 60-178491

[51] Int. Cl.[4] ..... G09G 1/14

[52] U.S. Cl. ..... 340/728; 340/735; 340/790

[58] Field of Search ..... 340/728, 790, 735

[56] References Cited

U.S. PATENT DOCUMENTS

| | | | |
|---|---|---|---|
| 3,894,292 | 7/1975 | Wilkinson et al. | 340/728 |
| 4,318,097 | 3/1982 | Oura | 340/728 |
| 4,612,540 | 9/1986 | Pratt | 340/728 |

*Primary Examiner*—Howard A. Birmiel

*Attorney, Agent, or Firm*—Lowe, Price, LeBlanc, Becker & Shur

[57] ABSTRACT

A method of forming a matrix image used in various devices with an image processing function.

In the image forming method, each image segment constituted by an m×n dot matrix is divided into at least one element, and each element is defined by a parallelogram on a basic matrix. The image segment is encoded according to characteristic features of the parallelogram. Data signals representing each image segment are stored in a set of at least one coded element in a memory. The dot patterns of the entire image are formed according to image segment display data. Even a complicated pattern can be smoothly and clearly formed. In addition, processing for obtaining an enlarged image or a rotated image can be simplified and performed with a small-capacity memory.

3 Claims, 16 Drawing Sheets

| FIG.19 | FIG.20 | FIG.21 | FIG.22 |
|---|---|---|---|
| $SR_S = YT' - ST$ | $SR_S = YT' - ST$ | $SR_S = 0$ | $SR_S = 0$ |
| $SR_E = SW$ | $SR_E = YB' - ST$ | $SR_E = YB' - ST$ | $SR_E = SW$ |
| $n = 0$ | $n = 0$ | $n = ST - YT'$ | $n = ST - YT'$ |

FIG.27
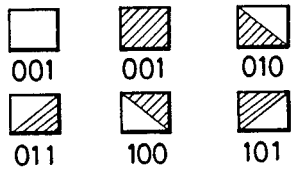
FIG.28
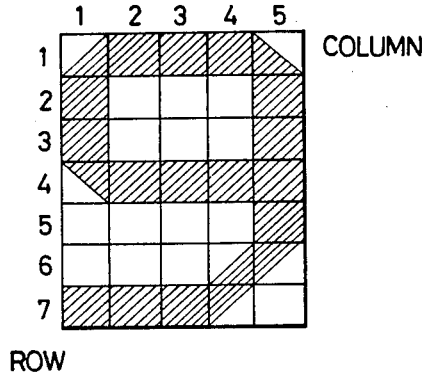
FIG.29
| ROW \ COLUMN | 1 | 2 | 3 | 4 | 5 |
|---|---|---|---|---|---|
| 1 | 011 | 001 | 001 | 001 | 010 |
| 2 | 001 | 000 | 000 | 000 | 001 |
| 3 | 001 | 000 | 000 | 000 | 001 |
| 4 | 100 | 001 | 001 | 001 | 001 |
| 5 | 000 | 000 | 000 | 000 | 001 |
| 6 | 000 | 000 | 000 | 011 | 101 |
| 7 | 001 | 001 | 001 | 101 | 000 |

METHOD OF FORMING MATRIX IMAGE

BACKGROUND OF THE INVENTION

The present invention relates to a method of forming a character font and a figure, which is applied to various devices with an image processing function such as a dot printer and a dot display device.

In a typical conventional method for forming a character font, each character font is defined by a dot pattern of m (rows)×n (columns) matrix, and each dot constituting the matrix corresponds to each bit of a memory, thereby storing the matrix pattern in the memory. However, this conventional method has the following drawbacks.

1. If a storage pattern, i.e., a basic pattern is enlarged at any magnification, smooth enlargement cannot be performed.

2. Many conversion operations are required to rotate the basic pattern.

3. The memory capacity is increased in proportion to the size (m×n) of the basic matrix.

In order to improve the drawback in item 1, there is proposed a prior art method and apparatus for forming each character by combining six different component shapes (U.S. Pat. No. 3,893,100).

This prior art will be briefly described.

Six different component shapes in FIG. 27 are combined to prepare a character pattern in FIG. 28. The six different component shapes are converted to 3-bit codes, respectively. A character is then stored in a matrix form, as shown in FIG. 29.

In this prior art, the following problems are posed when the character pattern is to be enlarged.

1. In four triangular graphic components (010 to 101 in FIG. 27), the inclination of the slope of each component shape is fixed at 45°. In order to set the angle to be variable, a large number of component shapes are required, resulting in impractical applications.

2. Many conversion operations are required to rotate the pattern. For example, in order to rotate the pattern stored in the memory, as shown in FIG. 29, through 90° and to print the rotated pattern, the bits of the fifth column in FIG. 29 must be rearranged to be those of the first row. For this purpose, the pattern codes must be rearranged, as shown in Table 1. In particular, since the pattern codes in FIG. 29 are stored in units of bytes (8 bits), many operations are required to perform rearrangements.

TABLE 1

| Before Rotation | | After 90° Rotation |
|---|---|---|
| 000 | → | 000 |
| 001 | → | 001 |
| 010 | → | 011 |
| 011 | → | 100 |
| 100 | → | 101 |
| 101 | → | 010 |

3. When the character generator size is increased, i.e., when the number of dots constituting a character is increased, the storage capacity and the processing time of the character generator are increased accordingly. According to the conventional method, the memory capacity of m×n×3 bits is required to store the m (horizontal)×n (vertical) matrix size regardless of the printing density. When the size of the character generator is increased (e.g., when m or n is increased), the memory capacity of the character generator is inevitably increased. In addition, the processing time is also increased in proportion to the increase in the memory capacity of the character generator.

The size of the character generator tends to be increased to obtain characters with higher printing quality. A matrix of 96×96 or larger has been used in practice.

SUMMARY OF THE INVENTION

It is an object of the present invention to provide a method of forming a matrix image, wherein a smooth pattern can be obtained even if a complicated pattern whose components are located at different angles is enlarged.

It is another object of the present invention to provide a method of forming a matrix image, wherein the number of conversion operations required for rotating a given pattern through 90°, 180°, 270°, or the like is not increased even if the size of a character generator is increased.

It is still another object of the present invention to provide a method of forming a matrix image, wherein the character generator does not require a large memory capacity even if its size is increased under the assumption that the number of elements constituting the image is kept unchanged.

According to the present invention, there is provided a method of forming a matrix image, comprising the steps of: (a) dividing each of at least one image segment which constitutes at least part of an image and which is constituted by an m×n matrix into at least one element; (b) specifying each element by a corresponding parallelogram on a basic m×n matrix; (c) encoding the element by characteristic features of the corresponding parallelogram; (d) storing data representative of each image segment in a form of a set of at least one coded element; and (e) forming an entire pattern of the image according to the thus stored data representing the at least one image segment.

BRIEF DESCRIPTION OF THE DRAWINGS

FIG. 27 is a diagram showing six graphic components constituting a character or the like according to a conventional method;

FIG. 28 is a chart showing a character pattern generated according to the method in FIG. 27; and FIG. 29 is a table showing a storage pattern of an image such as a coded character according to the method in FIG. 27.

DETAILED DESCRIPTION OF THE PREFERRED EMBODIMENT

Figure 1:
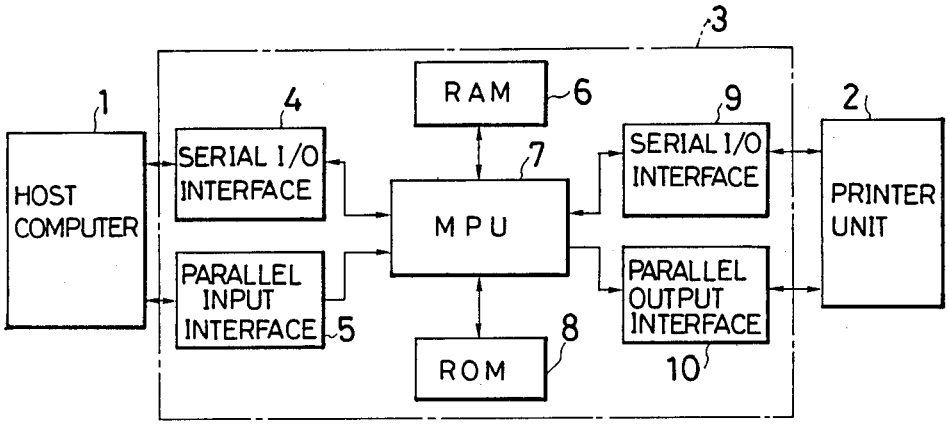
FIG. 1 is a block diagram schematically showing a printer and a host computer so as to practice a method of forming a matrix image according to an embodiment of the present invention.

FIG. 1 shows a dot matrix printer for practicing a method of forming a matrix image according to an embodiment of the present invention. The printer comprises a printer unit 2 for printing various types of images and a printer control circuit 3 connected to a host computer 1 for driving and controlling the printer unit 2. The printer control circuit 3 includes a serial I/O interface 4 and a parallel input interface 5 to receive serial and parallel data from the host computer 1. A microprocessor unit (to be referred to as an MPU hereinafter) 7 connected to the outputs of the interfaces 4 and 5 is connected to a dynamic RAM memory (to be referred to as a RAM hereinafter) 6. The RAM 6 is used to temporarily store different types of data and include memory areas as a receiver buffer, a segment attribute buffer, an element attribute buffer, an element pattern buffer, a screen buffer, a transmit buffer, and the like which will be described later. A ROM 8 connected to the MPU 7 serves as a character generator. A printer control program and character patterns mentioned below are stored in the ROM 8. A serial I/O interface 9 and a parallel output interface 10 connect the MPU 7 to the printer unit 2.

The character patterns stored in the ROM 8 serving as the character generator will be described with reference to FIGS. 2 to 5.

Figure 2:
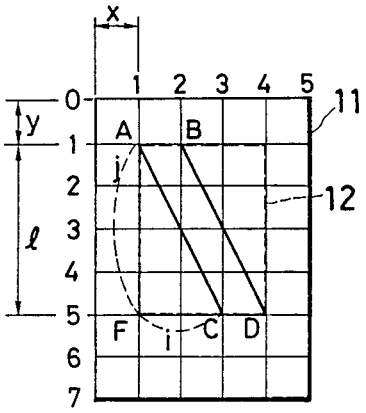
FIG. 2 is a chart for explaining an element in the embodiment of FIG. 1.
Figure 3:
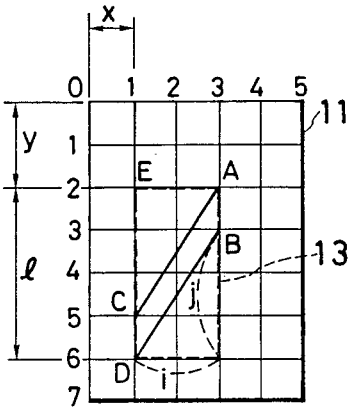
FIG. 3 is a view similar to FIG. 2.
Figure 4:
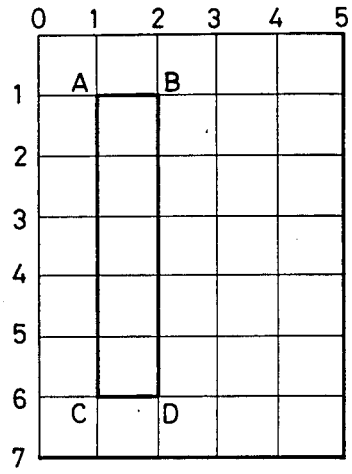
FIG. 4 is a view similar to FIG. 2.
Figure 5:
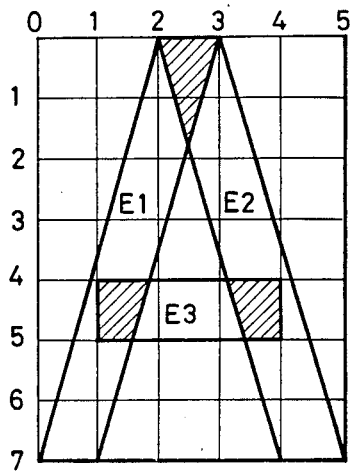
FIG. 5 is a chart showing a segment corresponding to letter "A" in the embodiment of FIG. 1.

FIGS. 2 to 4 respectively show three different elements constituting part of a character or of an image in this embodiment. Each element is constituted by a parallelogram drawn in a $7\times5$ basic matrix 11. These elements are combined to constitute an image segment such as letter "A" (FIG. 5).

Each element is defined by four types of data (i.e., four parameters) as follows:

(1) Direction (w) of a width of a parallelogram (2) Position (x,y) of the parallelogram with respect to the basic matrix 11

(3) Length (l) of the parallelogram (4) Inclination angle ($\theta$) of the parallelogram The sets of element display data each constituted by four types data, that is, different elements, are stored in the ROM 8.

A method for designating parameters w, x, y, l, and $\theta$ will be described below.

The direction w of width of the parallelogram, i.e., the first parameter is designated in the following manner. If the direction w is the direction of row, i.e., the horizontal direction, then $w=1$. However, if the direction w is the direction of column, i.e., the vertical direction, then $w=0$. The position (x,y) of the parallelogram, i.e., the second parameter, is designated by coordinates of the upper left corner of a rectangle (e.g., rectangles 12, 13, and 14 in FIGS. 2 to 4) circumscribed about the parallelogram and is stored in a memory. In the cases of FIGS. 2 and 4, the position (x,y) of the A point is given by coordinates $x=1$ and $y=1$ in the basic matrix 11. In the case of FIG. 3, the E point (x,y) of the basic matrix 11 is given by coordinates $x=1$ and $y=2$. The length l of the parallelogram, i.e., the third parameter, is designated by the column length (y) of the rectangle 12 or 13, except for the following case. If a rectangular extends in the horizontal direction (row direction), as indicated by E3 of FIG. 5, that is, if $\theta=0$ and $w=0$, then the row length is defined as l. The inclination angle $\theta$ of the parallelogram, i.e., the fourth parameter, is given by a slope of a side (inclined side) of the paralellogram which is not a side extending in the direction of width of the paralellogram. In other words, the angle 8 is determined by a ratio of the row component of the inclined side to the column component thereof, i.e., i/j. For instance, the row component i is defined as a value obtained by subtracting an x-coordinate of the vertex (F in FIG. 2) opposite the oblique side of a right-angled triangle, which is formed by the inclined side of the paralellogram and the above-mentioned circumscribed rectangle, from the x-coordinate of one end (e.g., C in FIG. 2) of one of the inclined sides of the parallelogram on the basic matrix 11. The column component j is defined by a value obtained by subtracting a y-coordinate of the other end (A in FIG. 2) of one inclined side of the parallelogram from the y-coordinate of the vertex F. If the components i and j can be divided without remainders, values obtained by dividing them by the greatest common measure are used as values for i and j. Therefore, the components i and j, and hence the angle $\theta$ are positive or negative values. The angle $\theta$ is designated by the values i and j obtained by dividing the row and column components by the greatest common measure and by a sign S of the slope (positive=0; and negative=1).

If the parallelogram is a rectangle extending along the vertical direction (i.e., the column direction), as shown in FIG. 4, then $i=0$ and therefore $\theta=0$. However, if the rectangle extends along the horizontal direction, then $\theta$ becomes infinite. However, exceptionally, $\theta=0$ ($i=0$). Whether the rectangular extends horizontally or vertically is determined by the value w, thus eliminating indeterminate factors. More specifically, if both $w=0$ and $\theta=0$, then a horizontally extended rectangle is represented, as indicated by E3 of FIG. 5. However, if both $w=1$ and $\theta=0$, then a vertically extended rectangle is represented, as shown in FIG. 4.

The four different parameters are designated as described above. An element constituted by parallelogram ABCD in FIG. 2 is defined by $i=1$, $j=2$, and $S=0$ since x=1, y=1, l=4, w=1, and $\theta$=row/column=(3−1)/(5−1)=2/4=½. The element constituted by parallelogram ABCD of FIG. 3 is defined by i=2, j=3, and S=1 since x=1, y=2, l=4, w=0, and $\theta$=(3−1)/(3−6)=−⅔. The element in FIG. 4 is defined by x=1, y=1, l=5, $\theta$=0 (i=0), and w=1. An element E1 constituting the segment A in FIG. 5 is defined by x=0, y=0, l=7, $\theta$=−(2/7), and w=1. An element E2 is defined by x=2. y=0, l=7, $\theta$=2/7, and w=1. An element E3 is defined by x=1, y=4, l=3, $\theta$=0, and w=0.

Figure 6:
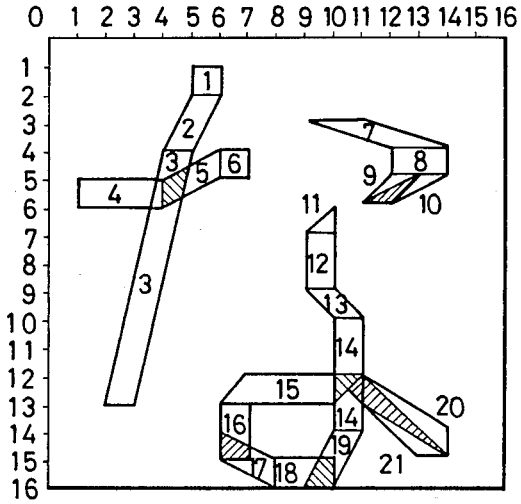
FIG. 6 is a chart showing a segment corresponding to kana character "ｱ" formed by using a 16×16 basic matrix.

The designation methods of parameters w, x, y, l, and $\theta$ have been described above. However, the ways of designating these parameters are not limited to those in the above embodiment. Any methods may be adapted if the four parameters are sufficiently expressed. Although the width of the parallelogram is defined as a value equal to one-unit length in the basic matrix 11 in the present embodiment, the width value may be variable within the confinement of the memory capacity. In addition, the image width may be widened by arranging identical parallelograms parallel to each other. In the present embodiment, the element position (x,y) is defined by the coordinates of the vertex of the upper left corner of the rectangle circumscribed about the parallelogram constituting the element so as to allow easy dot pattern expansion. However, the element position (x,y) may be defined by another point. In the above embodiment, the basic matrix is a 7×5 matrix. However, the size of the basic matrix is not limited to the 7×5 matrix. For example, a 16×16 matrix may be employed. For example, FIG. 6 shows kana character "ん" expressed by 21 elements using this basic matrix.

Figure 7:
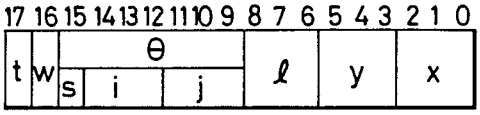
FIG. 7 is a data format of 18-bit data representing an element.
Figure 8:
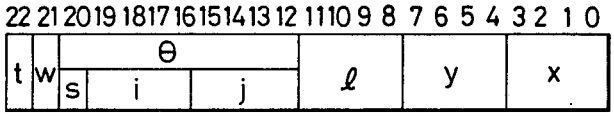
FIG. 8 is a data format of 23-bit element display data.

Data representing each segment constituting an image such as a character is constituted by 18-bit data (FIG. 7) for the 7×5 basic matrix, or 23-bit data (FIG. 8) for the 16×16 basic matrix. In the case of FIG. 7, each element display data consists of 6-bit element position (x,y) data, 3-bit length l data, the angle $\theta$ code S (one bit; if the slope sign is positive, S=0, but if the slope sign is negative, S=1), the i and j values, 1-bit width direction w data (=1 or 0), and a one-bit discrimination flag t (if a given element is the last element of the segment, t=1; otherwise, t=0) representing whether the given element is the last element of the segment.

Figure 9:
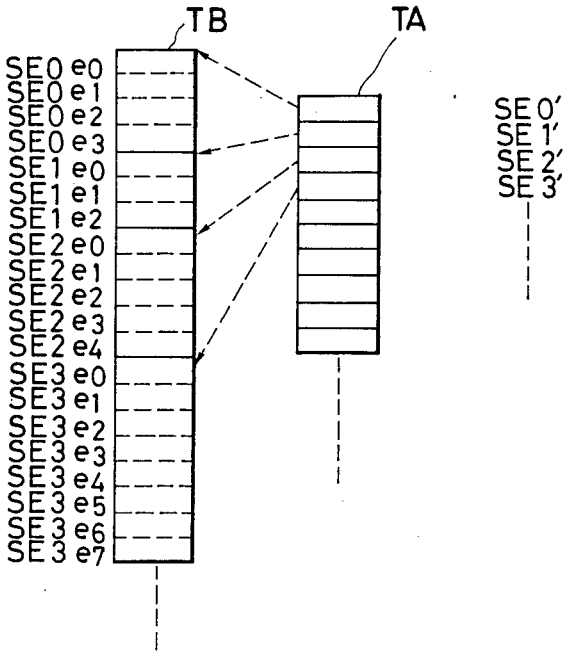
FIG. 9 is a memory map of a memory for storing element display data.

Element data in each segment is stored in an element table TB in the RAM 8 in units of segments, as shown in FIG. 9. An address table TA is also stored in the RAM 8 to store start addresses of the respective segments. In the case of FIG. 9, segment display data (to be referred to as a segment) SE0 consists of element display data SE0e0 to element display data SE0e3. A start address SE0′ of the element table TB is stored in the address table TA memory area corresponding to the segment SE0. A start address SEI′ of three elements SE1e0 to SE1e2 constituting the segment SE1 is stored in address table TA memory area corresponding to the segment SE1. Similarly, the start addresses of the respective segments of the element table TB are stored in the corresponding areas in the address table TA. The start addresses of the respective segments are stored as described above. At the same time, the last element of each segment is determined by the value of the last element discrimination flag t. Even if each segment is constituted an arbitrary number of elements, the storage data on the different segments can be identified.

According to the present invention as described above, the characters are stored in the ROM 8 as the character generator in the form of the parallelogram elements requiring a smaller number of bits. As compared with the conventional character generator storage method, the ROM requires a smaller memory capacity. Assume that letter "A" is stored by 5×7 component shapes and by 96×96 component shapes. In these cases, the required numbers of bits for storing letter "A" according to the method of this embodiment are compared with that of the conventional method described in U.S. Pat. No. 3,893,100.

(1) U.S. Pat. No. 3,893,100

For 5×7 component shapes

5×7×3 bits=105 bits

For 96×96 component shapes

96×96×3 bits=27,648 bits (2) Present Invention

The number of bits for each element in each matrix size is summarized in Table 2 below:

TABLE 2

| Segment Size | t | w | s | i | j | l | y | x | Total |
|---|---|---|---|---|---|---|---|---|---|
| 5 × 7 | 1 | 1 | 1 | 3 | 3 | 3 | 3 | 3 | 18 bits |
| 96 × 96 | 1 | 1 | 1 | 7 | 7 | 7 | 7 | 7 | 38 bits |

Since letter "A" is constituted by three elements,
For 5×7 component shapes

18×3=54 bits

For 96×96 component shapes

38×3=114 bits

Letter "A" is exemplified above. In the case of the method in U.S. Pat. No. 3,893,100, at least 105 bits are required for storing one segment by the 5×7 component shapes regardless of the number of elements. On the contrary, the data length is changed according to the number of elements constituting one segment in the present invention. According to the present invention, 18 bits are required for storing one element by the 5×7 component shapes. If six or less elements (105/18=6.8) are used, the required memory capacity is smaller than that of U.S. Pat. No. 3,893,100. In the case of the 96×96 component shapes, even if 727 or less elements (27648/38=727.6) are used for all segments in the present invention, the required memory capacity is the same as that of the U.S. Pat. No. 3,893,100. In practice, most segments can be formed using 100 or less elements. In addition, since the character generator is fabricated with high integration recently, the method of the present invention is advantageous in requiring only a small memory capacity.

According to the present invention, the tables TA, TB, etc. are stored in the ROM 8 as the character generator.

If all image signals for one frame of the display screen are dot-pattern converted, the required memory capacity is inevitably increased. However, conversion dot row by dot row requires too much time. Therefore, the frame is divided into a plurality of regions each of which is simultaneously subjected to dot conversion. The regions are referred to as screens hereinafter.

The operation of the printer according to this embodiment will be described hereinafter.

Figure 10:
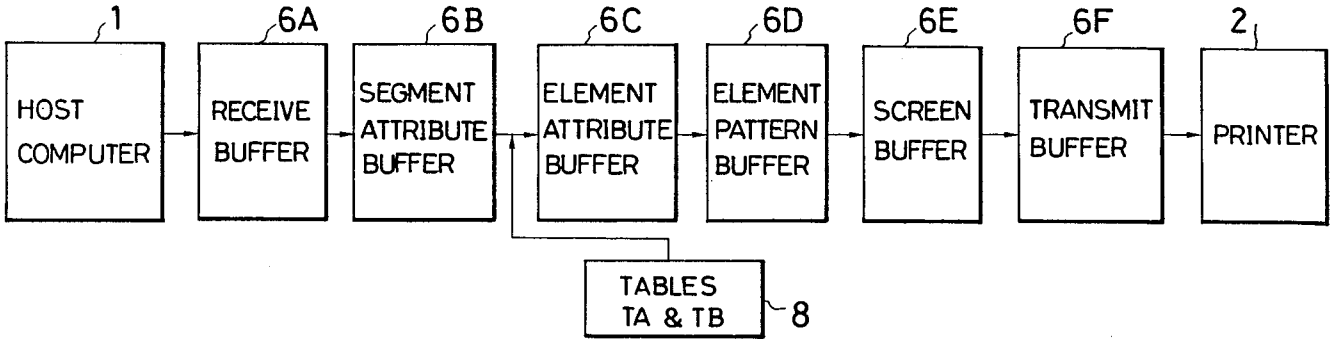
FIG. 10 is a block diagram showing the arrangment of a RAM in FIG. 1 and its peripheral devices.

The data flow in the printer of this embodiment will be described with reference to FIG. 10.

Data sent from the host computer 1 is stored in a receive buffer 6A in the RAM 6. Data is read out from the receive buffer 6A in units of bytes, and at the same time printing position data and printing character size data are stored in a segment attribute buffer 6B. If a printing instruction is sent from the host computer 1, the segment attribute buffer 6B is accessed from the start address. The element position data and element size data are stored in an element attribute buffer 6C so as to cause the tables TA ard TB stored in the ROM 8 to process the segments in units of elements. A dot pattern is formed in units of elements according to the data stored in the element attribute buffer 6C. The data patterns are stored in an element pattern buffer 6D. The data in the element pattern buffer 6D is written as OR signals in a screen buffer 6E, thereby forming a one-screen dot pattern. When all the elements within one screen are completely converted to the dot patterns, the contents of the screen buffer are copied to a transmit buffer as an output buffer. The printer unit 2 is started, and at the same time, the screen buffer is cleared. The next screen pattern is then prepared.

The above description has been made as the general flow of data processing in the printer. The operation of the printer will be described in detail below.

The following five data signals as character printing signals are supplied together with control signals such as a printing position code, an enlargement designation code, a rotation designation code, a terminator representing a termination of a character, and a character data end code.

Figure 11:
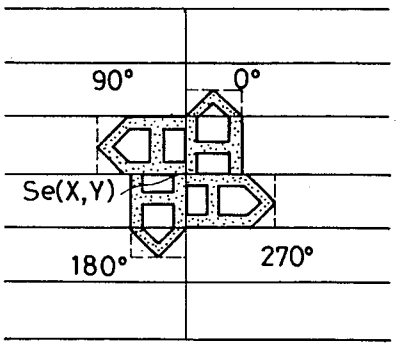
FIG. 11 is a chart for explaining the operation of segment rotation.

(1) Printing Position: Se(x,y)
(2) Horizontal Enlargement Factor: Eh
(3) Vertical Enlargement Factor: Ev
(4) Rotational Angle: 0°, 90°, 180°, and 270°
(5) Character data The printing position Se(x,y) represents coordinates of the center of rotation on the display screen, as shown in FIG. 11, and is represented by coordinates of a point on the display screen at which point the lower left corner of the basic frame 11 of FIGS. 2 to 4 is located.

When data from the host computer 1 is stored in the receive buffer 6A in the RAM 6, the MPU 7 starts processing shown in FIG. 14 so as to store segment attribute data in the segment attribute buffer 6B in a manner to be described later.

Figure 13:
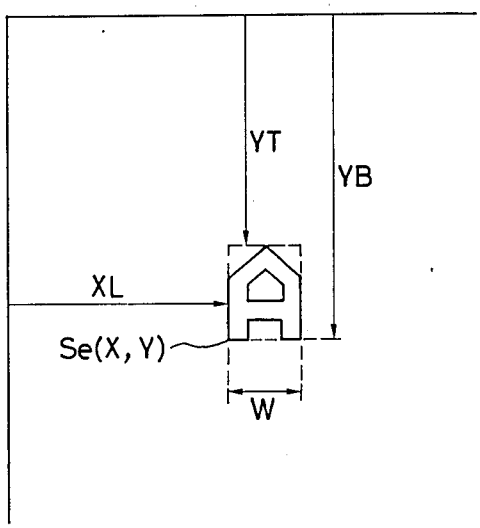
FIG. 13 is a chart showing the relationship between the frame and the segment attribute buffer.

The arrangement of the segment attribute buffer 6B will be described prior to a description of its processing of FIG. 14. The segment attribute buffer 6B is assigned with 12 bytes for one character, i.e., six words each constituted by two bytes. A vertical distance YT between the upper edge of the display screen and the upper edge of the segment is stored as the first word, as shown in FIG. 13. If segment enlargement is not performed, the vertical position of the upper edge of the basic matrix, which includes the elements constituting the segment, on the display screen is stored as the vertical distance YT. A vertical distance YB from the upper edge of the display screen to the lowermost edge of the segment is stored as the second word. A horizontal distance XL from the left edge of the display screen to the left edge of the segment is stored as the third word. A segment width W is stored as the fourth word. The attribute data is stored as the fifth word. The horizontal and vertical enlargement factors Eh and Ev are stored as the sixth word. In the attribute data, the character data is stored at the 0th to 7th bits, a flag representing the presence/absence of the enlargement instruction is set at the 13th bit, and data representing the rotational direction of the segment is stored at the 14th and 15th bits.

Figure 14:
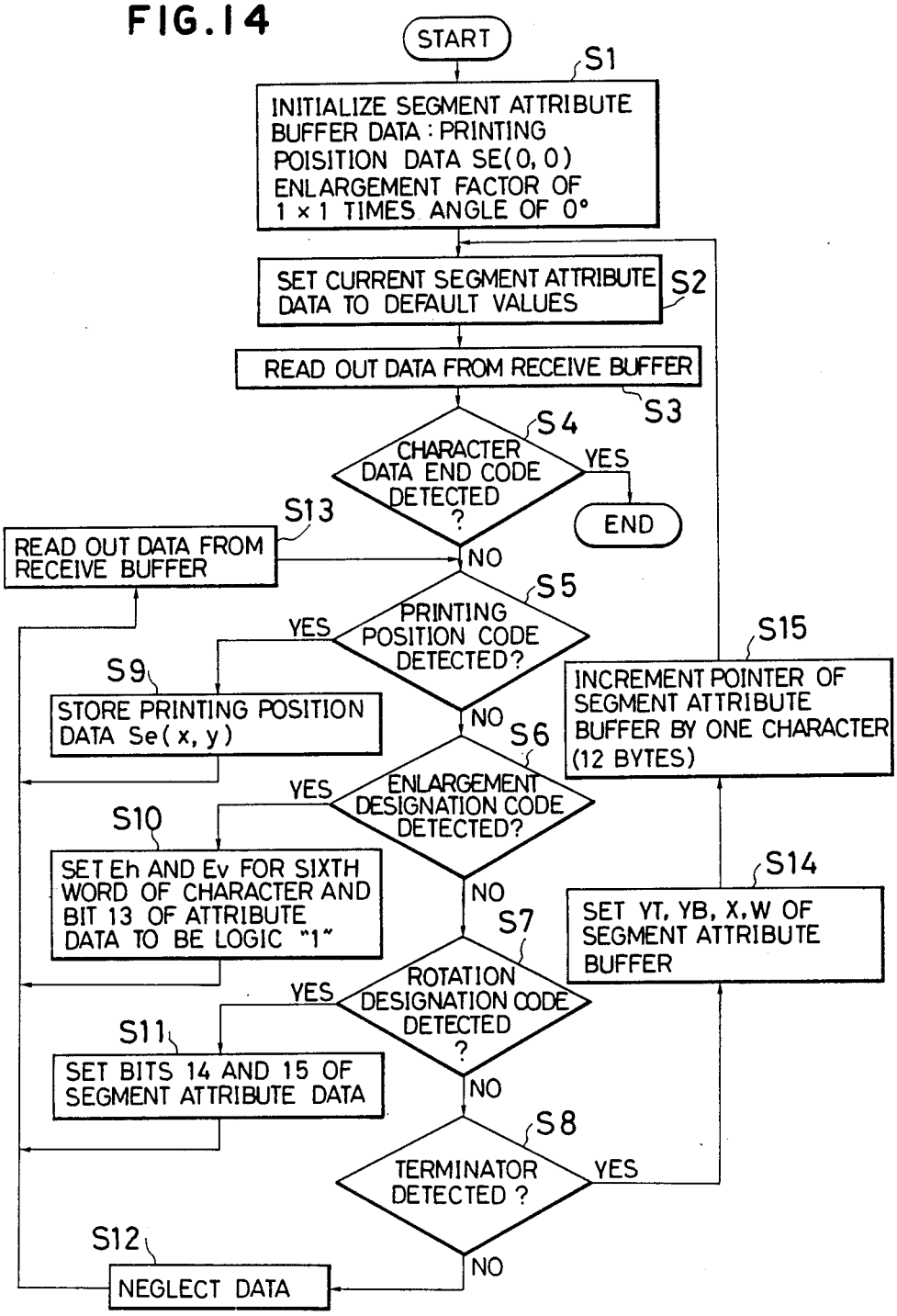
FIG. 14 is a flow chart for explaining the operation for generating segment attribute data.

In the processing of FIG. 14, the MPU 7 initializes the segment attribute buffer 6B. More specifically, the MPU 7 resets the pointer of the buffer 6B, sets the printing position Se(x,y) to be Se(0,0), sets the enlargement factors Eh and Ev to be 1, and sets the rotational direction to be 0° (step S1). The MPU 7 then sets the current data of the segment attribute buffer to be default values. More specifically, the enlargement factors Eh and Ev are set to be 1, the rotational angle is set to be 0°, and the printing position is set to be the current position step S2). The MPU 7 then reads out 1-byte data from the receive buffer (step S3). The MPU 7 determines whether the read data is a character data end code (step S4). If NO in step S4, the MPU 7 determines whether the fetched data is the printing position code (step S5), the enlargement designation code (step S6), the rotational designation code (step S7), and the terminator (step S7). If the MPU 7 determines that the fetched data is the printing position data, the printing position data Se(x,y) is temporarily stored in the buffer in step S9. The next one-byte data is read out from the receive buffer in step S13. The operations in step S5 and the subsequent steps are repeated again. If the fetched data is determined to be the enlargement designation code (step S6), the received enlargement factors Eh and Ev are stored in the 6th word memory area of the segment attribute buffer, and the 13th bit of the attribute is set to be logic "1" (step S10) so as to store reception of such code. If the enlargement designation code is not detected, the 13th bit of the attribute is kept set at logic "0". If the fetched data is determined to be the rotational designation code (step S7), the rotational code (e.g., 0°=00, 90°=01, 180°=10, or 270°=11) is stored in the 14th and 15th bits of the segment attribute (step S11). If none of the printing designation code, the elargement designation code, the rotational designation code, and terminator is detected (step S8), the fetched data is neglected (step S12). Another one-byte data is read out from the receive buffer 6A, and the operations in step S5 or the subsequent steps are repeated. When the terminator representing the termination of the character is detected (step S8), the read printing position Se(x,y), the enlargement factors Eh and Ev, and the rotational angle data are used to calculate distances YT, YB and XL, and the segment width W. The calculated values are set in the corresponding word positions (storage positions) of the corresponding character in the segment attribute buffer 6B.

The above data calculations are performed in the following manner (FIG. 13). Reference symbol Ph denotes a width (the row length) of the basic matrix 11 constituting the segment; and Pv, a length (the row length) of the basic frame 11.

(1) If the rotational angle is 0°

$$YT = Y - Ev \cdot Pv$$

$$YB = Y$$

$$XL = X$$

$W = Eh \cdot Ph$ (2) If the rotational angle is 90°

$YT = Y - Ev \cdot Ph$ $YB = Y$ $XL = X - Eh \cdot Pv$ $W = Eh \cdot Pv$ (3) If the rotational angle is 180°

$YT = Y$ $YB = Y + Ev \cdot Pv$ $XL = X - Eh \cdot Ph$ $W = Eh \cdot Ph$ (4) If the rotational angle is 270°

$YT = Y$ $YB = Y + Ev \cdot Ph$ $XL = X$ $W = Eh \cdot Pv$

The data signals YT, YB, XL, and W are respectively stored in the 1st, 2nd, 3rd, and 4th words of the character in the segment attribute buffer 6B (step S14).

The pointer of the segment attribute buffer 6B is incremented by one character, i.e., 12 bytes, and the operations in step S2 and the subsequent steps are repeated to convert the all sent data. The converted data is stored in the segment attribute buffer 6B, and finally the character data end code is read (step S4). The conversion processing is then completed.

Figure 15:
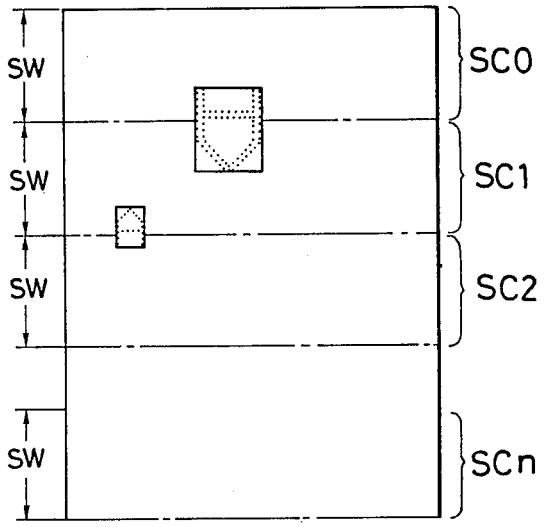
FIG. 15 is a chart showing a state wherein the frame is divided into screens 1 to n.

A dot pattern is formed by using the segment attributes in the segment attribute buffer 6B. This dot pattern is processed in units of elements. If the entire frame is converted to the dot patterns at once, a large memory capacity is required and a long processing time is required. As shown in FIG. 15, the frame is divided into screens SC0 to SCn in units of predetermined ranges SW (e.g., in units of 32-dot rows), and the dot patterns are sequentially formed. This dot pattern formation will be described with reference to FIG. 16.

A screen counter ST is initialized to set the first dot row number of the first screen SC0. In this embodiment, the first dot row number is "0" and set in the counter (step S16). The pointer SP of the segment attribute buffer 6B is initialized. That is, the start address of the segment attribute buffer 6B is set (step S17). The screen buffer 6E is cleared (step S18). The distances YT and YB (FIGS. 12 and 13) as a part of the segment attribute data read out from the segment attribute buffer 6B designated by the pointer SP are compared with the count of the screen counter ST to determine in step S19 whether at least part of the segment is present in the screen. In other words, the MPU 7 checks whether $YB < ST$ or $YT > ST + SW$ is established. If either condition is determined to be established, the segment is located above or below the corresponding screen. In other words, the MPU 7 determines that the segment is not located within the corresponding screen. The flow advances to step S36. If neither conditions are established, the MPU 7 determines that at least part of the segment is present within the corresponding screen. In this case, the flow advances to step S20. It should be noted that $(ST + SW)$ represents the first dot row of the subsequent screen since the screens are obtained by segmenting the frame in units of SW (32) dot rows.

Figure 12:
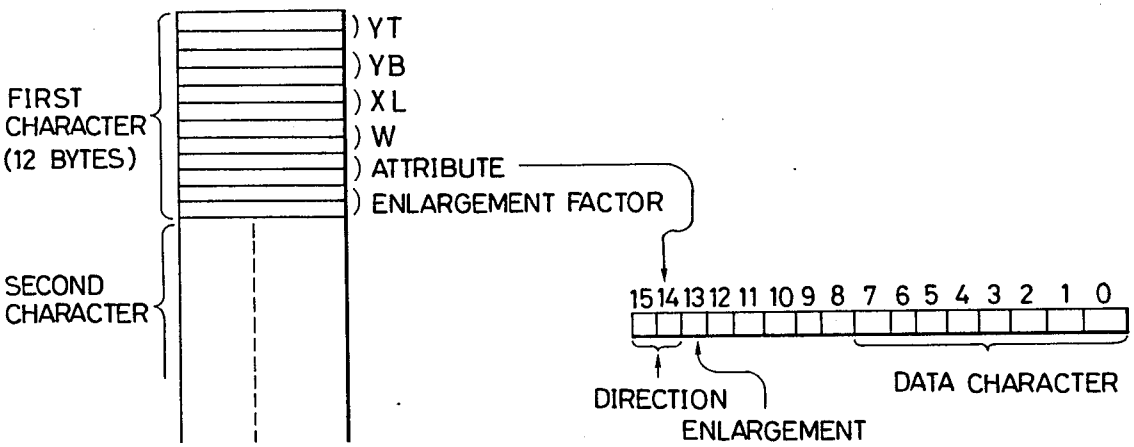
FIG. 12 is a data format showing a segment attribute buffer.

The address of the element table TB which corresponds to the start element of the character segment corresponding to the given data is read out from the address table TA (FIG. 9) in response to the character data read out from the segment attribute buffer 6B (FIGS. 12 and 13). The data (x, y, l, $\theta$, and w) of the first element e0 read out from the memory area at the address of the element table TB is stored in the element attribute buffer 6C. The MPU 7 determines in step S21 according to the currently read segment attribute data (14th and 15th bits of the fifth word in FIG. 12) whether or not the rotational designation code is detected. If YES in step S21, the attribute of the element corresponding to the designated rotational angle is generated (step S22).

Figure 17:
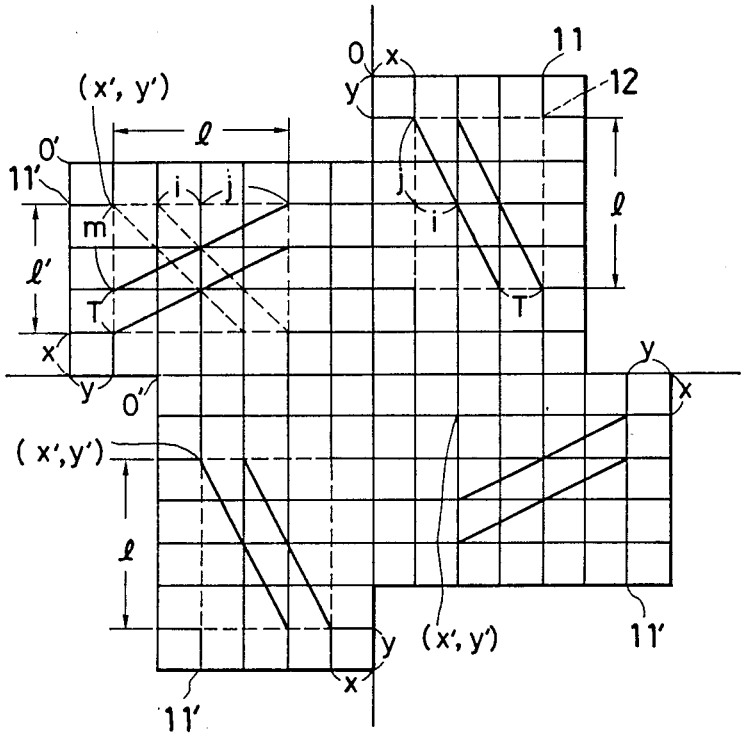
FIG. 17 is a chart for explaining the operation for rotating the element.

Rotational conversion will be described with reference to FIG. 17. The data signals x, y, l, j, and i (FIGS. 7 and 8) have the relationship (FIGS. 2 and 3) described in the first quadrant in FIG. 17. When the basic matrix 11 is rotated through 90° counterclockwise, the element position is shifted to position (x',y'). In other words, the upper left corner position of the rectangle circumscribed about the parallelogram constituting the elements specifies the position (x',y'). At the same time, the values of the coordinates x' and y' are equal to the horizontal and vertical distances from the upper left corner (O') of the basic matrix 11'. As a result, values of the coordinates x' and y' from the upper left corner of the basic matrix rotated through 90° and the length l' of the parallelogram are calculated as. follows:

If $w = 1$, $l' = T + m'$ where T is the one-unit length (the width of the element line) in the matrix 11 or 11', and $m = l \times (1/j)$, therefore, $l' = T + x(i/j)$ If $w = 0$ $l' = (l - T) \times (i/j)$ $x' = y$ $y' = 5 - x - l'$ Since the inclination angle $\theta = (i/j)$ of the parallelogram is 90°, $i' = j$ and $j' = i$. The sign s' of the slope is inverted (i.e., $s' = -1 \times s$). In addition, the direction w' of the width of the parallelogram is $w' = 0$ for $w = 1$; $w' = 1$ for $w = 0$. Furthermore, if the basic matrix is rotated through 180° and 270°, the updated element data values are x', y', l', i', j', s', and w', as summarized in Table 3.

TABLE 3

| | 90° | 180° | 270° |
|---|---|---|---|
| l' | $T + l \times (i/j)$ for $w = 1$ $(l - T) \times (i/j)$ for $w = 0$ | l | $T + l \times (i/j)$ for $w = 1$ $(l - T) \times (i/j)$ for $w = 0$ |
| x' | y | $5 - x - \{T + l \times (i/j)\}$ for $w = 1$ $5 - x - (l - T) \times (i/j)$ for $w = 0$ | $7 - y - l$ |
| y' | $5 - x - l'$ | $7 - y - l$ | x |
| i' | j | i | j |
| j' | i | j | i |
| s' | $s \times (-1)$ | s | $s \times (-1)$ |
| w' | 0 | w | 0 |

TABLE 3-continued

| 90° | 180° | 270° |
|---|---|---|
| for w=1 | | for w=1 |
| 1 | | 1 |
| for w=0 | | for w=0 |

Figure 18:
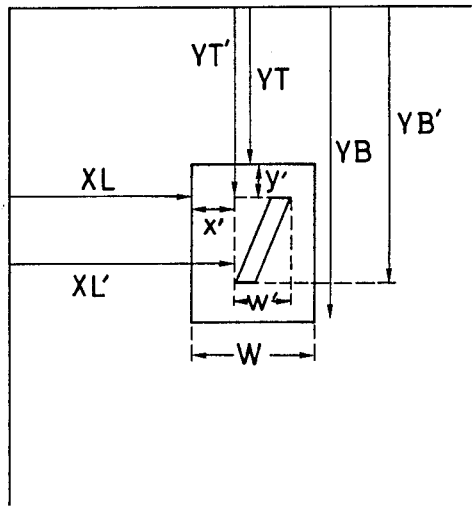
FIG. 18 is a chart for explaining the relationship between the frame and element attribute data.

The element attribute data signals YT', YB', X', W', and $\theta'$ considering the enlargement factors are calculated using the element data obtained with and without rotation (step S23). This data conversion will be described with reference to FIG. 18. The distance YT' between the upper edge of the display screen to the upper edge of a certain element is obtained such that a product of the distance y' between upper edge (the upper edge of the basic matrix) of the segment including the element and the element upper edge and the vertical enlargement factor Ev is added to the distance YT between the upper edge of the screen and the upper edge of the segment. If no rotation is involved, the value of y' is equal to the value y read out from the element table. For the sake of simplicity, the data after rotation is given as y'. Therefore, in this case, x'=x, y'=y, l'=l, i'=i, j'=j, s'=s, w'=w. Similarly, the element attribute data signals YT', YB', XL', W', $\theta'$ after enlargement are calculated as follows:

$$YT'=YT+y'\times Ev$$

$$YB'=YT+(y'+l')\times Ev$$

$$XL'=XL+x'\times Eh$$

ti $\theta'=(i'/j')\times(Eh/Ev)\times 100$

The width W' (FIG. 18) of the rectangle circumscribed about the parallelogram constituting the element is calculated as follows:

If w'=1

$$W'=\{T+l'\times(i'/j')\}\times Eh$$

If w'=0

$$W'=(l'-T)\times(i'/j')\times Eh$$

The value is multiplied with 100 in the calculation of the angle $\theta$ in order to improve the calculation precision assuming a case wherein the resultant value is a fraction.

The element attribute data obtained as described above is stored in the element attribute buffer 6C in the same form as in the segment attribute buffer 6B. The vertical distance YT' up to the upper edge of the element is stored as the first word; the vertical distance YB' up to the lower edge of the element is stored as the second word; the horizontal distance XL' up to the side edge of the element is stored as the third word; the width W' of the horizontal direction of the element is stored as the fourth word; the inclined angle $\theta$ is stored in the 0th to 12th bits of the fifth word; t representing the end of the element is stored at the 13th bit of the fifth word; a sign s of the slope is stored at the 14th bit; and a direction w is stored at the 15th bit.

The MPU 7 determines in step S24 according to the distances YT' and YB' stored in the element attribute buffer 6C whether the element falls within the screen. In other words, the MPU 7 checks whether conditions ST+SW<YT' or ST>YB' is established. If either condition is determined to be established, the MPU 7 determines that the element is not present in the corresponding screen. In this case, the flow advances to step S40.

Figures 19, 20, 21, 22:
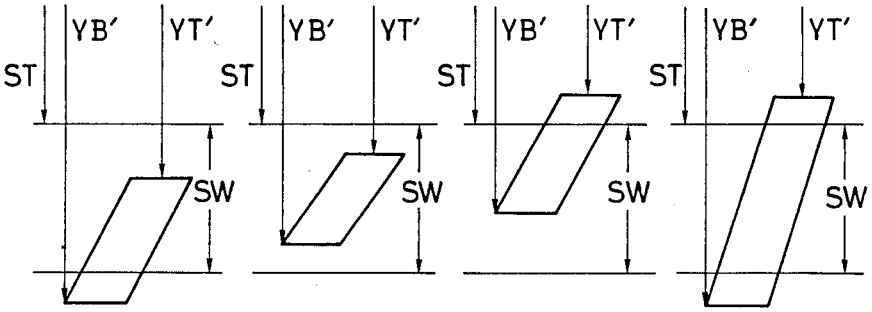
FIG. 19 is a chart for explaining the relationship between the screen and one element.
FIG. 20 is a chart similar to FIG. 19.
FIG. 21 is a chart similar to FIG. 19.
FIG. 22 is a chart similar to FIG. 19.

If neither conditions are established in step S24, the MPU determines that the element is present in the screen in one of the conditions shown in FIG. 19 to 22. The MPU 7 determines in step S25 according to the distance YT' to the upper edge of the element whether the element upper edge is present within the corresponding screen. If the positional relationships given in FIGS. 19 and 20 are obtained so as to satisfy condition ST+SW>YT'≧ST, a value (SRs=YT'−ST) obtained by subtracting the value of the screen counter ST from the value of the distance YT' representing the upper edge of the element is set in a screen row counter SRs. Value "0" is set in an element row counter n (step S26). The MPU 7 then determines in step S27 according to the distance YB' representing the lower edge position of the element whether the element lower edge is located outside the screen. If the element lower edge is located outside the screen, as shown in FIG. 19, a screen end row register $SR_E$ is set to be the width SW ($SR_E$=SW) of one screen (step S28). If the lower edge position falls within the screen, as shown in FIG. 20, the screen end row register $SR_E$ is set for the distance from the top of the screen to the lower edge of the element, i.e., $SR_E$=YB'−ST. The distance from the top of the screen to the upper edge of the element to be drawn in the screen is set in the screen row counter SRs. The distance from the top of the screen to the lower edge of the element is set in the screen end row register $SR_E$. The element row counter n is used to store a shift amount to be described later. If the positional relationship in FIG. 19 or 20 is obtained, no shifting is performed. Therefore, the element row counter n is set to be "0".

If the upper edge of the element is determined not to be located within the corresponding screen in step S25, i.e., if the state in FIG. 21 or 22 is obtained, the element is located within at least part of the screen including its top. Value "0" is set in the screen row counter SRs (step S30). Subsequently, the MPU 7 determines in step S31 according to the distance YB' representing the lower edge position of the element whether the lower edge is located within the screen, i.e., either state of FIG. 21 or 22 is assumed. If the lower edge position of the element is determined to be located within the screen (in the case of FIG. 21), the distance YB'−ST from the top of the screen to the lower edge of the element is stored in the screen end row register $SR_E$. The distance ST−YT' from the upper edge of the element to the top of the screen is set in the element row counter n (step S33). If the lower edge of the element is determined to be located outside the screer (FIG. 22), the screen width SW is set in the screen end row register $SR_E$, and ST−YT' is set in the element row counter n (step S32).

The dot pattern is formed in the element pattern buffer 6D according to the value of the element row counter n, the angle $\theta'$ of the element, the sign s' of the slope, the enlargement factors Eh and Ev, and the direction w' of width of the element (steps S34 to S39).

Figure 23:
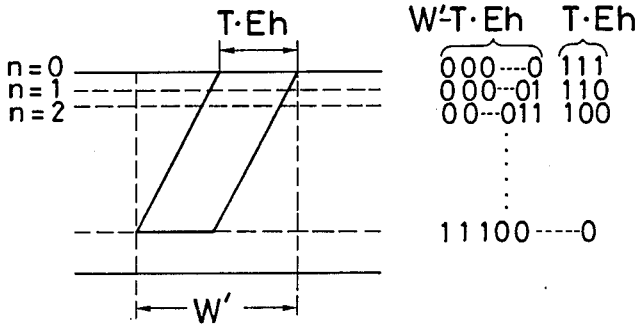
FIG. 23 is a chart for explaining an operation for setting bits constituting a dot pattern.
Figure 24:
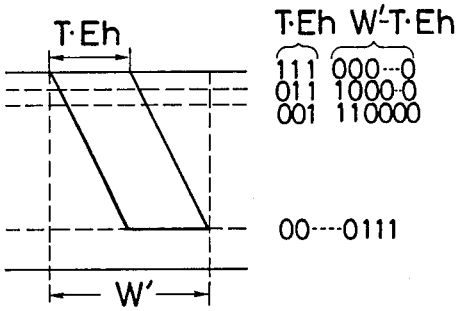
FIG. 24 is a chart similar to FIG. 23.

If the direction of the width of the element is the row direction (w'=1) and the sign s' of the slope is negative (s'=1), the element shown in FIG. 23 is to be formed. However, if the sign s' is positive (s'=0), the element in FIG. 24 is to be formed. If the element row counter n=0, i.e., if the screen dot pattern corresponding to the upper edge rf the element is to be formed, "1"s are set in the bits, the number of which corresponds to the value obtained by multiplying the horizontal enlargement factor Eh with the width T (FIG. 17) of the element line and which corresponds to the right side of the display screen, among the bits the number of which corresponds to the width W' of the segment in the buffer 6D. The remaining bits are set to be logic "0". If the value of the element row counter n is not "0", the dot pattern is shifted by a shift amount AS calculated by equation (1). If $s'=1$ (negative), the the dot pattern is shifted to the left. However, if $s'=0$ (positive), the dot pattern is shifted to the right. The resultant dot pattern is set in the buffer 6D:

$$AS=ROU\{n\theta'(Eh/Ev)\} \quad (1)$$

where ROU(X) is the rounded value of X.

Figure 25:
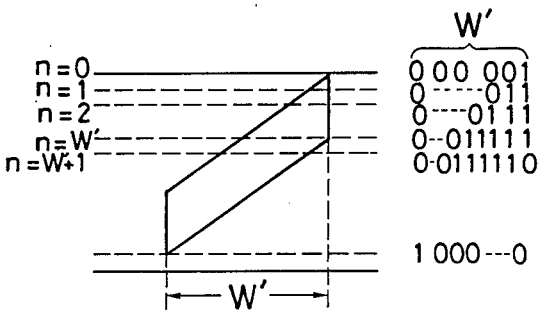
FIG. 25 is a chart similar to FIG. 23.
Figure 26:
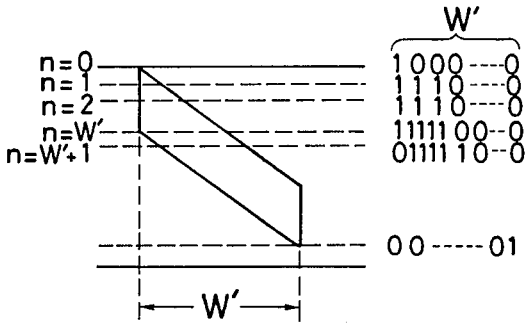
FIG. 26 is a chart similar to FIG. 23.

If the direction of the width of the element is the column direction ($w'=0$), the element shown in FIG. 25 or 26 is to be formed. In this case, if $n=0$, logic "1" is set in the last bit ($s'=1$ and the case of FIG. 25) or the first bit ($s'=0$ and the case of FIG. 26) corresponding to the value obtained by multiplying the vertical enlargement factor Ev with the segment width T. The dot pattern is shifted to the left or right while the count of the element row counter n is set at "1" until the count. thereof reaches the element width T·Ev according to equation (1). When the count of the element row counter n exceeds the value T·Ev, the count is reset to "0". The dot pattern is then shifted to the left or right while "0" is set the element row counter n. The resultant data is set in the element pattern buffer 6D. The first dot row is stored in the element pattern buffer (step S34 in FIG. 16).

Figure 16A:
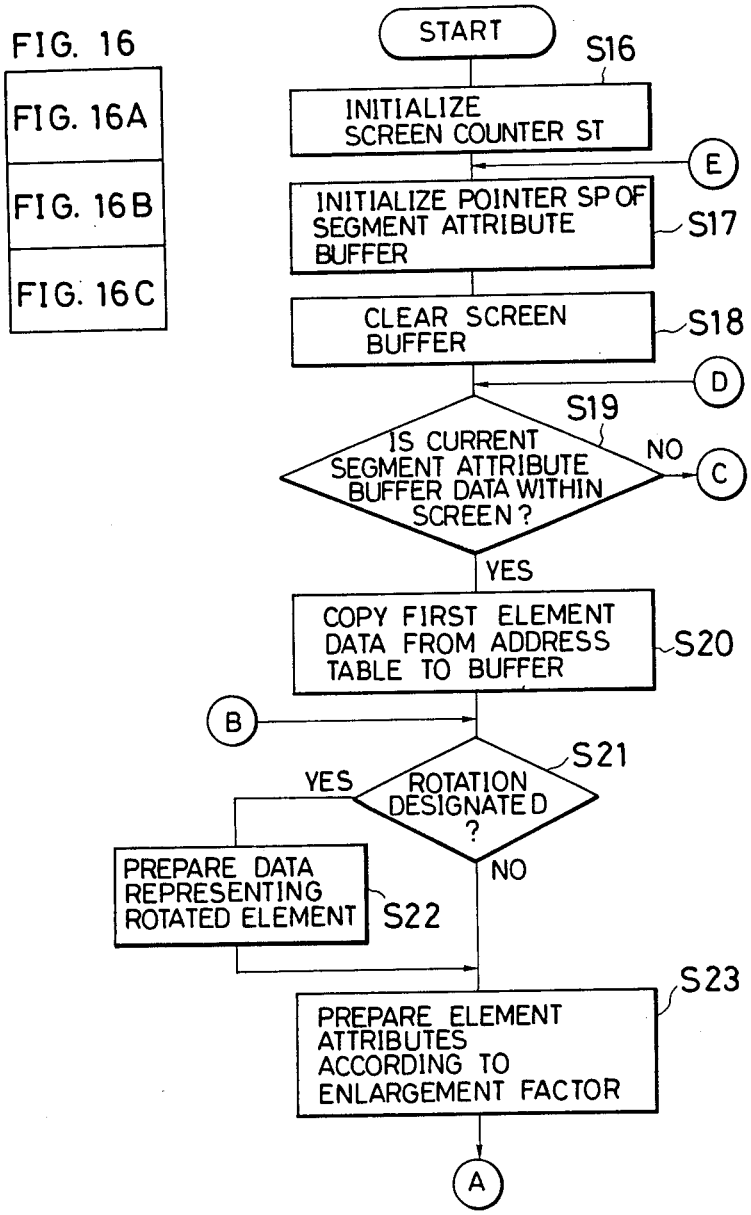
FIG. 16 is a flow chart for explaining the operation for generating a dot pattern.
Figure 16B:
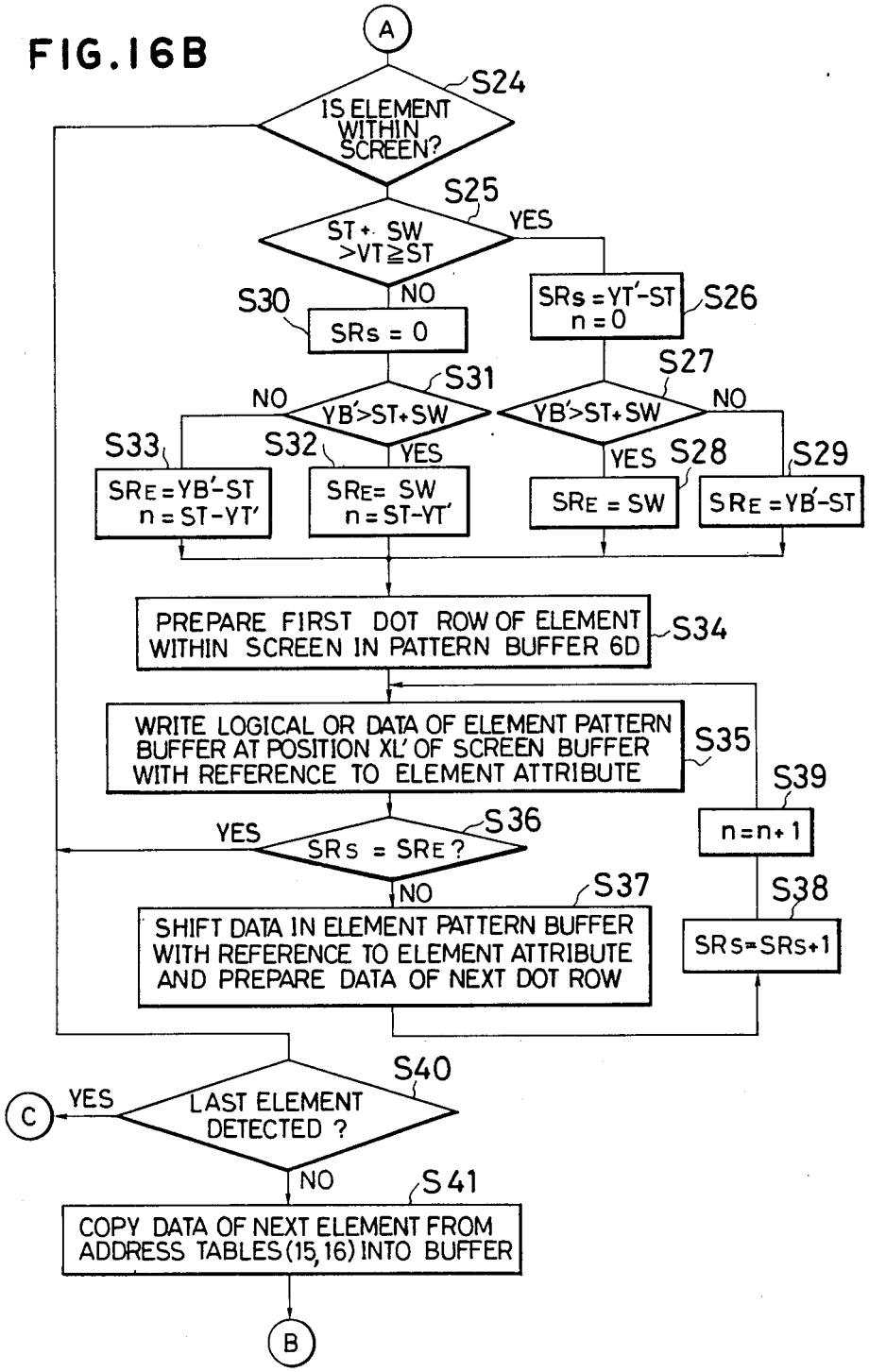
Figure 16C:
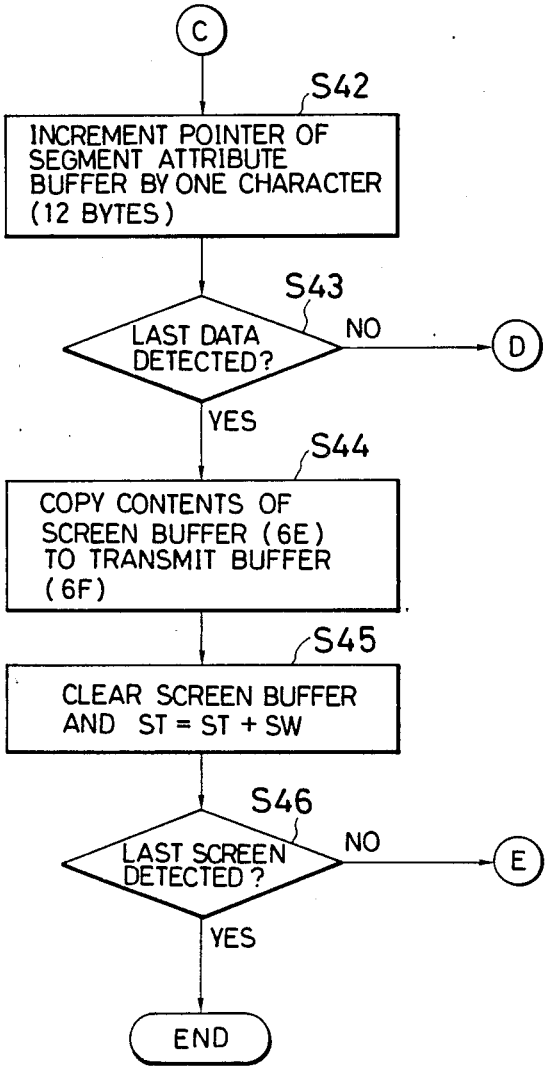

In step S35, the data in the element pattern buffer 6D is written as an OR signal in the screen buffer 6E storage position corresponding to the horizontal distance XL' representing the element side edge position, among the element attribute data formed in step S23 of FIG. 16. The MPU 7 determines in step S36 whether the value of the screen row counter SRs is the last dot row to be drawn on the screen, i.e., whether or not the value of the screen row counter SRs coincides with the screen end row register $SR_E$ set in any one of steps S28, S29, S32 and S33. If NO in step S36, the element pattern buffer data is shifted by a shift amount AA to the left or right according to the logic to be defined in equation (2) by referring to the element attributes, thereby forming the next dot row data (step S37):

$$AA=ROW\{n\theta'(Eh/Ev)\}-ROU\{(n-1)\theta'(Eh/Ev)\} \quad (2)$$

Shifting is completed to obtain the next dot row data, the screen row counter and the element row counter n are respectively incremented by one (steps S38 and S39), and the operations in step S35 and the subsequent steps are repeated. When the dot pattern for one element is obtained and the last dot row within the screen is obtained (step S36), the MPU 7 determines whether the 13th bit of the fifth word of the element attribute is set at logic "1", i.e., the discrimination flag t representing the last element is set at logic "1" (step S40). If NO in step S40, the next data is copied from the address and element tables TA and TB and stored in the buffer (step S41), and the operations in step S21 and the subsequent steps are repeated. When all dot patterns for all elements of the corresponding character (segment) located within the screen are stored in the element pattern buffer 6D, the pointer of the segment attribute buffer 6B is incremented by one character (i.e., 12 bytes) (step S42). If the readout data is determined not to be a code representing the last data (step S43), the flow returns to step S19. The screens are created in units of elements of the corresponding character in the manner as described above, and the OR signals are written in the element pattern buffer 6D. If the data read out from the segment attribute buffer 6B is determined to represent the code representing the end of the data (step S43), the dot pattern in the screen buffer 6E is copied to the transmit buffer 6F (step S44), and the screen buffer is cleared. The value SW (32) is added to the screen counter ST (step S45). The MPU 7 determines in step S46 according to the value of the screen counter ST whether the last screen counter ST is ended. If NO in step S46, the operations in step S17 and the subsequent steps are performed. The printer unit 2 is driven by the data copied in the transmit buffer. The data is printed at the printer unit 2 in units of screens.

The above embodiment exemplifies the case of a printer. However, the present invention may also be applicable to a display device. The basic matrix for storing the element is exemplified by a 7×5 matrix. However, the element may be defined by an m (rows)×n (columns) (m and n are any integers) basic matrix.

According to the present invention, the following advantages are obtained as follows.

(i) An image such as a character is decomposed into elements each consisting of a parallelogram, and the set of elements is stored so that the image such as a character is stored. The memory as the character generator can have a small capacity. In particular, even if the size of the image such as a character is increased, the number of stored elements is kept unchanged. As compared with the conventional case wherein the image is stored according to dot-to-bit correspondence, the memory capacity need not be increased even if the size of the image is increased.

(ii) Even if elements constituting lines of an image such as a character are inclined at various angles with respect to the m×n basic matrix, the elements can be accurately defined. The lines constituting the image such as a character are smooth. A clear image can be produced even if it is enlarged.

(iii) Elements constituting an image are rotated to obtain a rotated image such as a character. Even if the image size is increased, the time required for rotational conversion is given unchanged and is not increased. The processing procedures are not complicated regardless of the sizie of the image such as a character.

What is claimed is:

1. A method of forming a matrix image, comprising the steps of: (a) dividing each of at least one image segment which constitutes at least part of an image and which is constituted by an m×n matrix into a plurality of elements; (b) specifying said elements by corresponding parallelograms, each of said parallelograms on a basic m×n matrix wherein at least some of said parallelograms append or intersect with other parallelograms; (c) encoding each of the elements by characteristic features of a corresponding parallelogram said features including position, length, an inclination angle and direction of a width of the parallelogram; (d) storing data representative of each image segment in a form of a set of at least one coded element; and (e) forming an entire pattern of the image according to the thus stored data representing said at least one image segment.

2. A method according to claim 1, wherein the step (e) includes the step of obtaining a rotated image of at least one image segment, the step of obtaining the rotated image being performed by rotating the basic matrix corresponding to the image segment and the element constituting the image segment.

3. A method according to claim 1, wherein the step (e) includes the second step of obtaining an enlarged image of at least one image segment, the second step being performed by enlarging the basic matrix corresponding to the image segment and the element constituting the image segment along at least one of row and column directions.

* * * * *